US009551163B2

(12) United States Patent
Anaya Perez

(10) Patent No.: US 9,551,163 B2
(45) Date of Patent: Jan. 24, 2017

(54) MODULAR SYSTEMS FOR CONSTRUCTING LIQUID STORAGE TANKS

(71) Applicant: Javier Anaya Perez, Jalisco (MX)

(72) Inventor: Javier Anaya Perez, Jalisco (MX)

( * ) Notice: Subject to any disclaimer, the term of this patent is extended or adjusted under 35 U.S.C. 154(b) by 399 days.

(21) Appl. No.: 14/093,457

(22) Filed: Nov. 30, 2013

(65) Prior Publication Data

US 2014/0151378 A1 Jun. 5, 2014

(30) Foreign Application Priority Data

Nov. 30, 2012 (MX) ..... MX/A/2012/013986
Aug. 28, 2013 (MX) ..... MX/A/2013/009944

(51) Int. Cl.

| | |
|---|---|
| ***B65D 6/34*** | (2006.01) |
| ***B65D 90/02*** | (2006.01) |
| ***E04H 7/20*** | (2006.01) |
| *B65D 6/00* | (2006.01) |

(52) U.S. Cl.
CPC ..... *E04H 7/20* (2013.01)

(58) Field of Classification Search
CPC . B65D 88/022; B65D 88/9024; B65D 90/023; B65D 90/046; E03B 3/03; E02D 27/38; E02D 3/10; E02D 7/00; E04H 7/20
USPC ..... 220/565, 4.12, 4.17, 4.16, 495.01, 692
See application file for complete search history.

(56) References Cited

U.S. PATENT DOCUMENTS

| | | | | |
|---|---|---|---|---|
| 4,244,486 | A * | 1/1981 | Ewald, Jr. | B65D 88/06 220/4.12 |
| 4,765,775 | A * | 8/1988 | Kroger | B65D 90/24 405/129.8 |
| 4,865,213 | A * | 9/1989 | Kruger | B65D 90/24 220/4.16 |
| 6,695,534 | B2 * | 2/2004 | Cain | B65D 90/24 405/114 |
| 8,590,727 | B2 * | 11/2013 | Dupuis | F01M 11/03 220/495.11 |
| 2004/0190993 | A1 * | 9/2004 | Archer-Simms | E02B 3/102 405/110 |
| 2009/0041543 | A1 * | 2/2009 | Kroger | B65D 90/24 405/114 |
| 2011/0265405 | A1 * | 11/2011 | Ksenych et al. | E04H 4/005 52/264 |
| 2013/0048630 | A1 * | 2/2013 | Zajicek et al. | B65D 90/24 220/4.13 |
| 2013/0105475 | A1 * | 5/2013 | Marshall | B65D 90/24 220/4.12 |

(Continued)

*Primary Examiner* — J. Gregory Pickett
*Assistant Examiner* — Niki M Eloshway
(74) *Attorney, Agent, or Firm* — Defillo & Associates, Inc; Evelyn A. Defillo

(57) ABSTRACT

A modular system for constructing liquid storage tanks, comprising prefabricated reinforced concrete modular elements designed and adapted to be coupled together to form the tank walls and having means for engaging the bottom slab or foundation. Optionally, the system further comprises elements which mate with the tank wall elements in order to build a covered tank. In one embodiment of the system, the modular wall elements include a prestressing wire or strand embedded in its structure and to which a tensile force is applied to produce a compressive stress in the side of the wall element that is contact with the liquid stored in the tank. Optionally, the constructing system comprises elements to form divisions or cells inside the storage tank.

13 Claims, 23 Drawing Sheets

(56) References Cited

U.S. PATENT DOCUMENTS

| | | | | |
|---|---|---|---|---|
| 2014/0255108 | A1* | 9/2014 | McDowell | E02D 31/002 405/270 |
| 2014/0298739 | A1* | 10/2014 | Pound | B65D 90/24 52/274 |

* cited by examiner

MODULAR SYSTEMS FOR CONSTRUCTING LIQUID STORAGE TANKS

BACKGROUND OF THE INVENTION

Field of the Invention

The invention relates to the field of building structures by using modular elements, and more specifically relates to modular systems for to constructing liquid storage tanks.

Description of the Related Art

Different types of liquid storage tanks are already known. For instance, those tanks constructed by using the traditional casting moulds or shorings and other constructed by prefabricated modular elements that are transported to the site where the tank will be built. The latter type corresponds to the modular system of the present invention.

The Spanish Utility Model No. 1043885 describes a modular tank for storing liquids, which is formed by curved or arched rectangular plates which are connected to each other to form the cylindrical surface of the tank. The plates constitute the modules externally having polyester circular reinforcing tubular ribs extending longitudinally along the larger dimensions of the curved module. The engagement of the modules is carried out by inserting screws in through holes located in the proximity of the vertical edges of the plates. Like any circular structure, the configuration of a circular tank has the disadvantage of missing an important land extension when a large structure is to be built or the structure cannot be fit into a small land space.

The Spanish Utility Model No. 1 047 505 describes an enhanced water tank comprising reinforced concrete prefabricated side walls placed vertically to form a ring structure on a reinforced concrete foundation jointly forming a water storage receptacle. The walls have ribs that provide the necessary strength to withstand the pressure of the water stored in the tank. The connection of adjacent surfaces is carried out by metal bridges that comprise nutted bolts passing through tubular sections welded onto the ends of the reinforcements of the walls.

The Spanish Utility Model No. 1 051 024 describes a prefabricated modular container for storing liquids, which comprises a foundation in which the bottom protruding ends of prefabricated concrete side members are embedded by using shoe armour and strap, said side members being reinforced by ribs on its outer face and having an opening or recess for the internal ventilation of the container. In the center of the foundation, a column is vertically positioned on whose upper end and the perimeter of the container some elements serving to form a container cover are supported. As a single central column is proposed to support the cover elements, it is concluded that the proposal is for storage tanks of small capacity, which means that said container has the disadvantage of being limited to a certain not size very large dimensions, as often required in some industrial applications (wastewater treatment plants, drinking water storage tanks, etc.).

The Spanish Utility Model No. 2 004 776 describes and illustrates a prefabricated modular container which comprises a plurality of elements, each consisting of a substantially rectangular plate having a stiffening rib, wherein the side by side arrangement of said elements forms the faces of a right prism around a base or foundation. The ribs of the elements include a pair of holes, one top hole through which a perimeter ring passes and acts as a reinforcement strap of the assembly, and a bottom hole to which an outer bead is fastened at the level of the foundation, said bead being common to all the elements.

While the concept of modularity is already known and anticipated by previous proposals, none of them describes something that is essential in the construction of liquid storage tanks, as the provision of the required modular elements for constructing tanks where the dimensions of said elements are not always multiples of the width of the modular elements forming the walls of the container due to, for example, the size or configuration of the land where the tank will be constructed. The provision of modular elements specially designed to overcome the above disadvantage is a principal object of the present invention. To do this, in addition to wall modular elements that form the tank walls, the new modular system proposes adjustment and corner elements by which any problems that might arise in the sizing of the tank are solve

SUMMARY OF THE INVENTION

According to a first embodiment of the invention, the modular system is designed for the construction of uncovered liquid storage tanks. In this first embodiment, the modular system comprises modular elements that form the walls of the storage tank, said elements consisting in a plurality of wall members adapted for side by side connection each other so that alltogether define a predetermined length of tank wall; fitting elements designed for connection with the outermost wall member of the tank wall; and corner elements to be placed in each corner of the tank structure and laterally connected to respective fitting elements. In addition, the wall members, and the fitting and corner elements include coupling elements to connect to the foundation of the tank to ensure rigidity and stability of the whole structure and to transmit the hydrostatic and hydrodynamic loads exerted against the walls to the tank foundation.

According to a second embodiment of the invention, the modular system is designed for the construction of covered liquid storage tanks. To this purpose, in addition to the elements described above, the system includes cover elements for roofing the storage tank, which consist of a plurality of slab modules having ribs or girders strategically distributed therein to provide each module with the stiffness required to cover large gaps; columns strategically placed in the liquid containment area to assist in forming a support structure of the slab modules. Each column comprises a head or crown at the top which serves to connect to said modules and means for fixing and connecting with the foundation; and girders that are placed on the head of said columns to form together with the latter a supporting structure on which the slab modules are placed to cover the tank.

Additionally, according to a third embodiment of the invention, the system for constructing liquid storage tanks comprises pre-stressed concrete prefabricated modules comprising prefabricated reinforced concrete modular elements adapted for connection each other to form the walls of the storage tank. The system comprising: a) a plurality of reinforced concrete wall elements that are interconnected side by side so that alltogether form a predetermined length of tank wall, each wall element has a head or crown at the top, which includes elements for coupling with other elements of the tank; said head also acts as a support for the slab modules when a covered tank is constructed; at least a cofferdam extending longitudinally along the wall member, said cofferdam directly supporting the hydrostatic and hydrodynamic forces caused by the liquid contained in the tank and being sized to optimize the weight and rigidity of the member; side and center buttresses that support the cofferdam and transmit the forces exerted on said said cofferdam to the foundation; and a shoe that acts as an element for engagement with the bottom slab of the tank by mechanical connectors or corrugated rod overlappings; b) fitting elements for connection with the outermost wall member of the wall formed by the wall members, and; c) corner elements to be placed in each corner of the tank structure, said corner elements being connected laterally with respective fitting elements. Each of the elements described above include coupling elements to connect with the foundation of the tank. Fundamentally, the innovation of the construction system of this embodiment is that the wall elements comprise at least one prestressed wire embedded in its structure. Once the concrete has obtained a compression strength as a result of the setting or hardening, a tensile strength is applied to the wire to produce a compressive stress on the wall cofferdam, which is in contact with the liquid stored in the tank, thereby the hydrostatic pressure exerted on said liquid tank wall is counteracted.

DETAILED DESCRIPTION OF THE PREFERRED EMBODIMENTS OF THE INVENTION

Referring to the accompanying figures, the invention consists in a modular system for the construction of liquid storage tanks. The modular system comprises prefabricated reinforced concrete elements, which have geometric and structural characteristics that provide great advantages in the construction of liquid storage tanks of large capacity.

Figure 1:
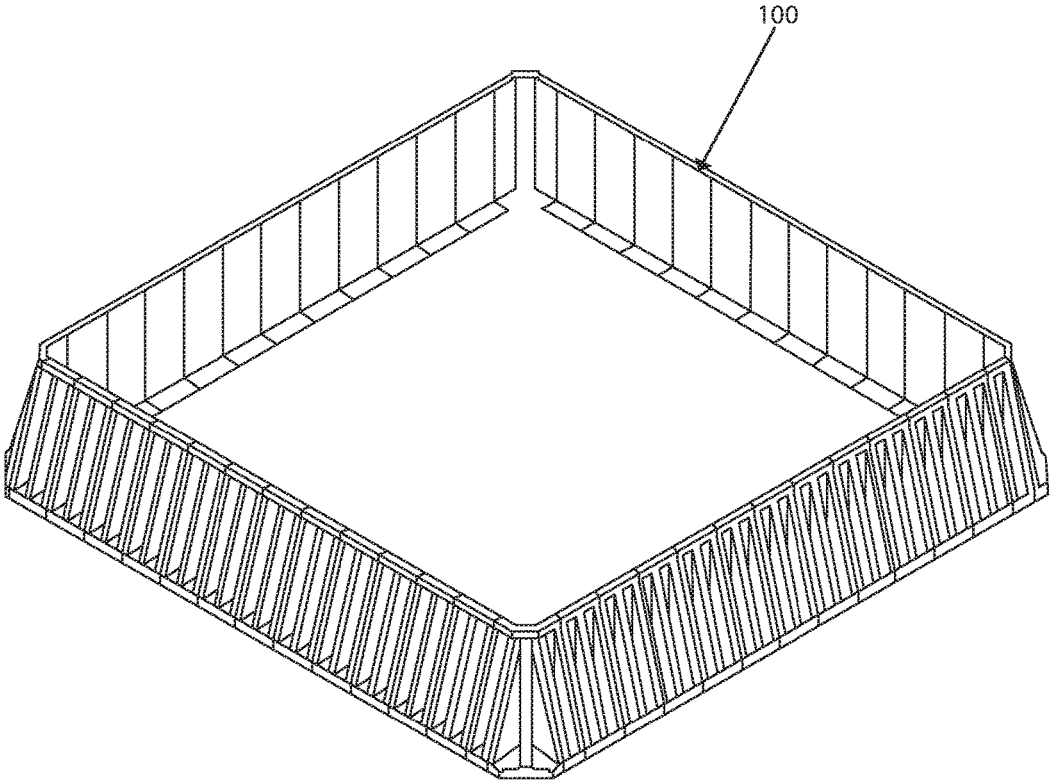
FIG. 1 is a top plan view of an exemplary embodiment of an uncovered liquid storage tank constructed with the modular system of a first embodiment of the invention.
Figure 2A:
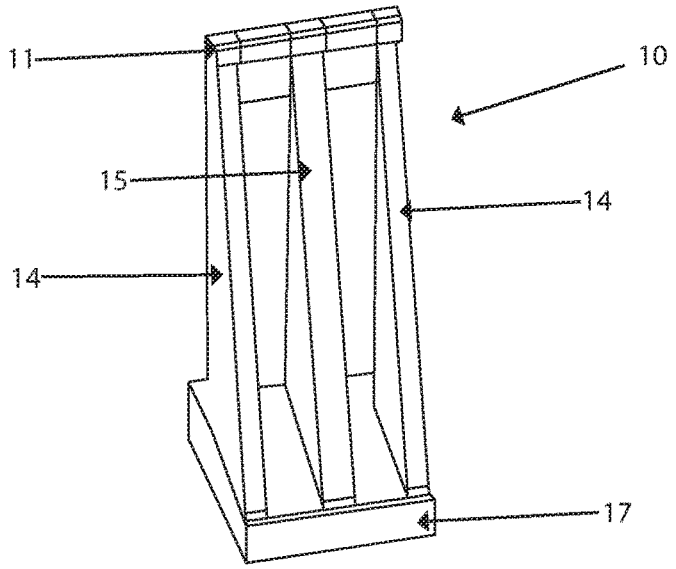
FIGS. 2*a*-2*d* illustrate a wall member of the modular system of the invention.
Figure 2B:
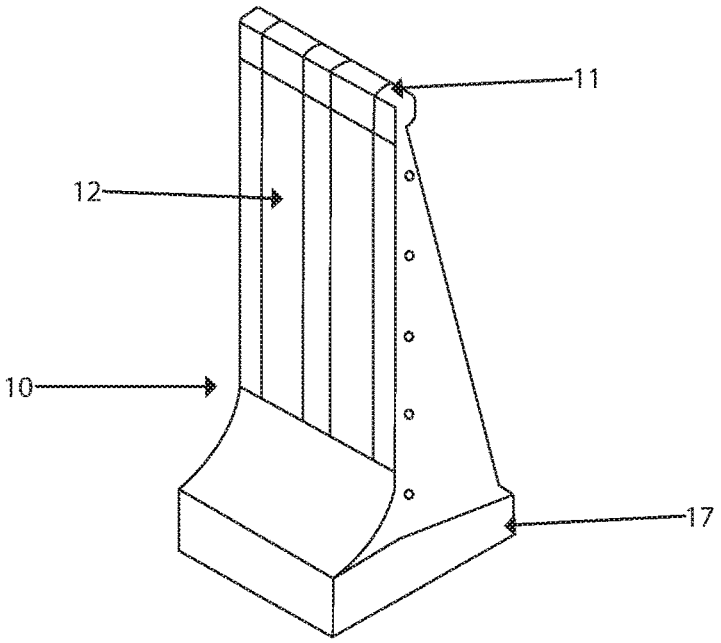
Figure 2C:
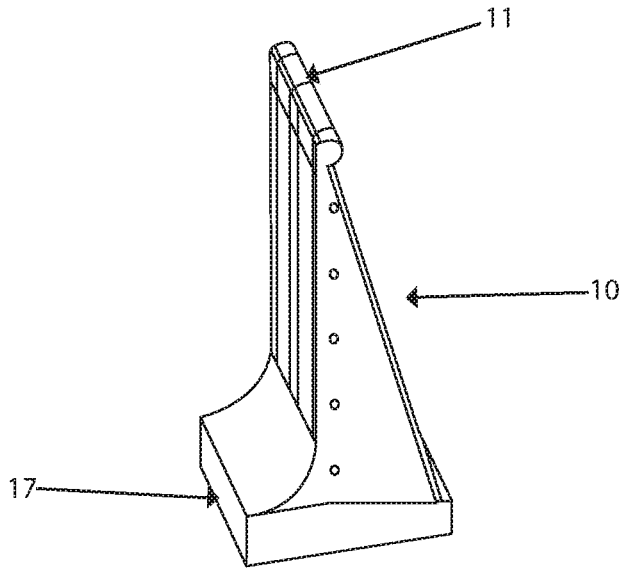
Figure 2D:
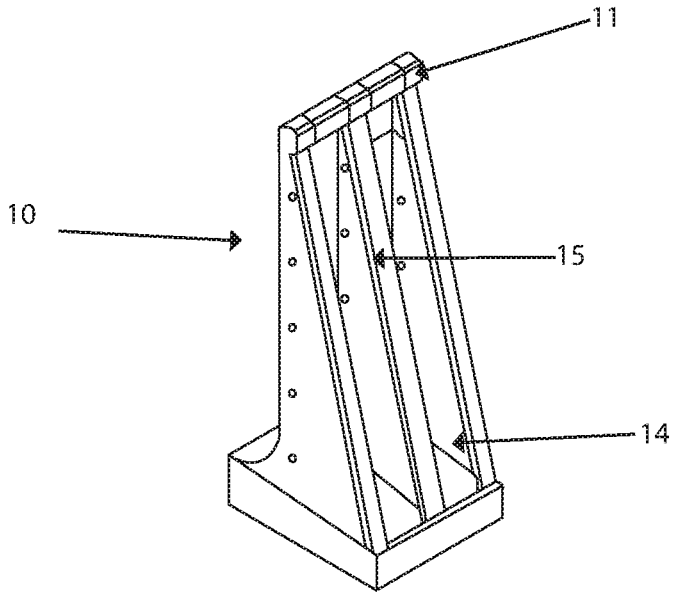
Figure 3A:
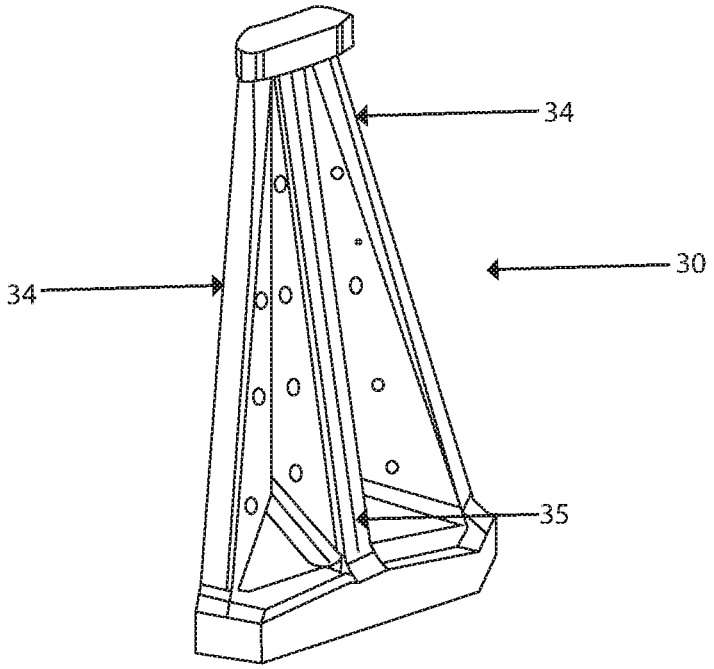
FIGS. 3*a*-3*d* illustrate the corner element of the new modular system.
Figure 3B:
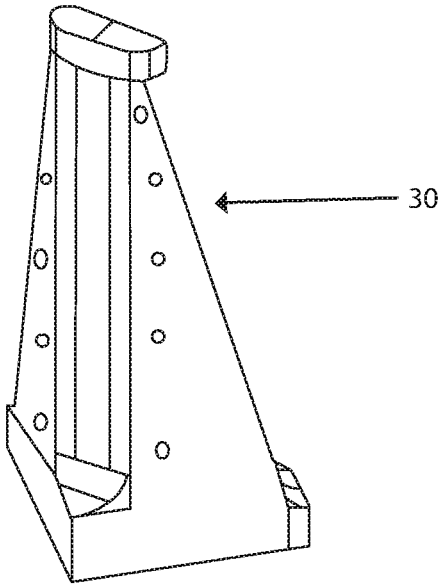
Figure 3C:
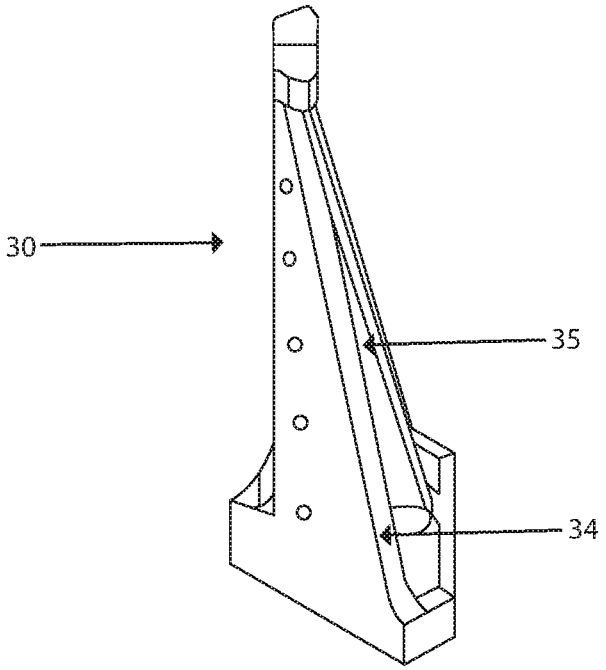
Figure 3D:
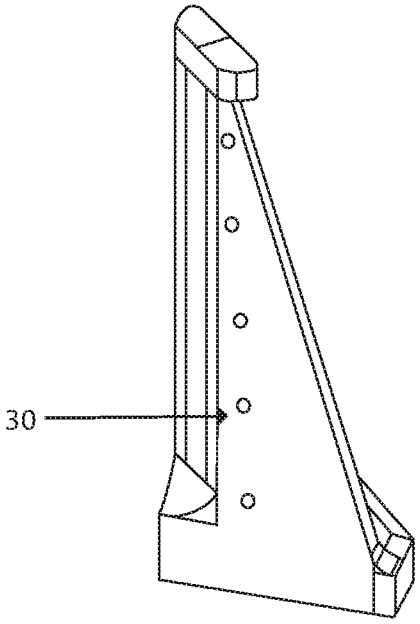
Figure 4A:
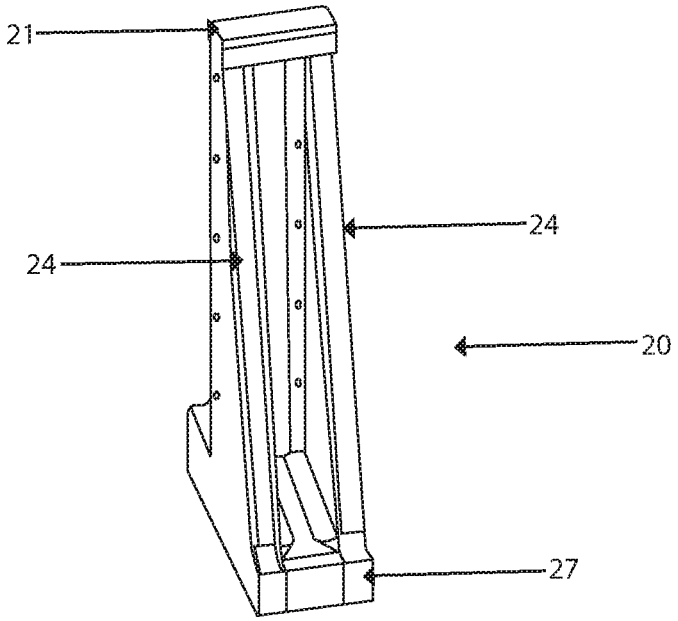
FIGS. 4*a*-4*d* illustrate a fitting element of the modular system of the invention.
Figure 4B:
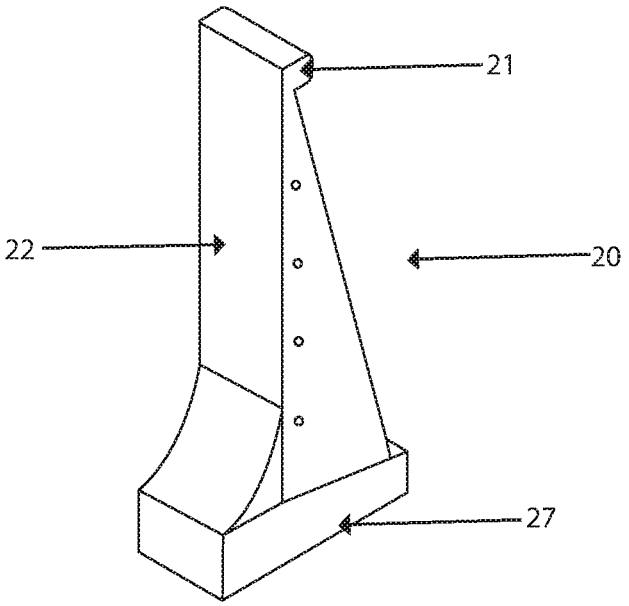
Figure 4C:
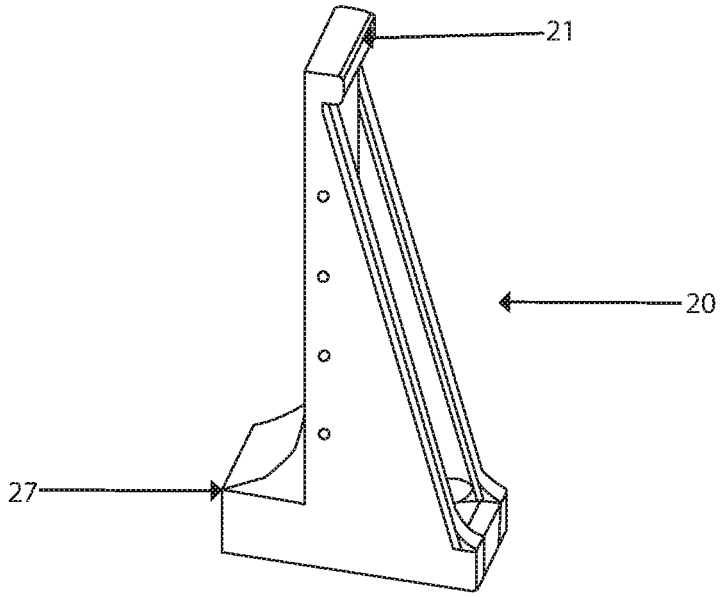
Figure 4D:
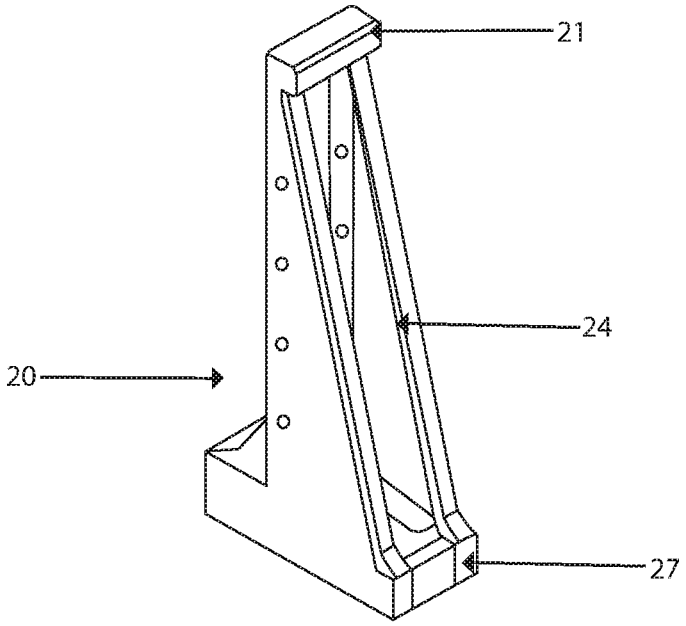
Figure 5:
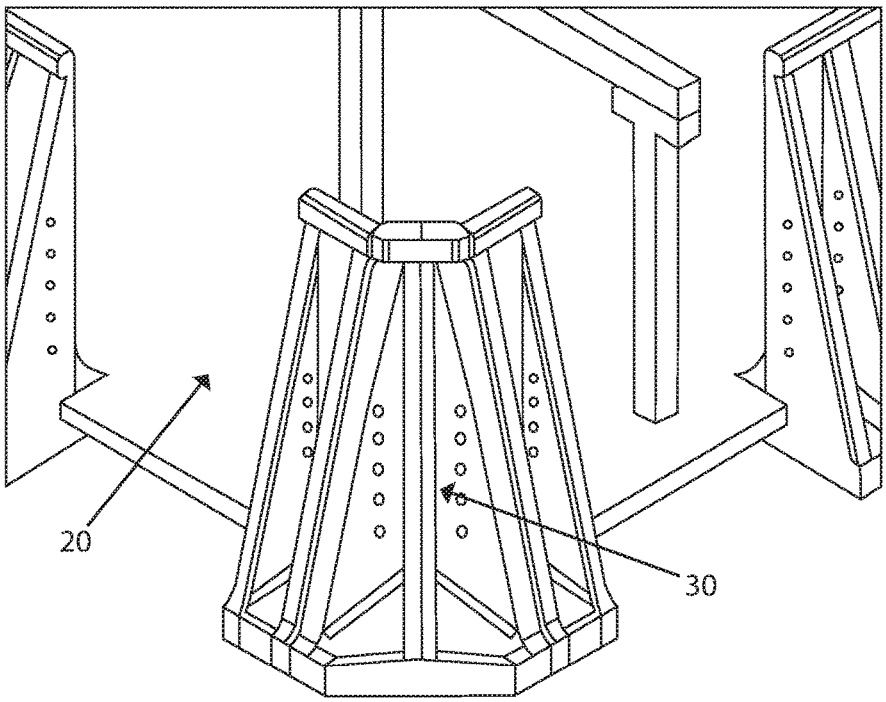
FIG. 5 is a detailed view of a corner of the storage tank assembled by the modules illustrated in the previous figures.
Figure 6:
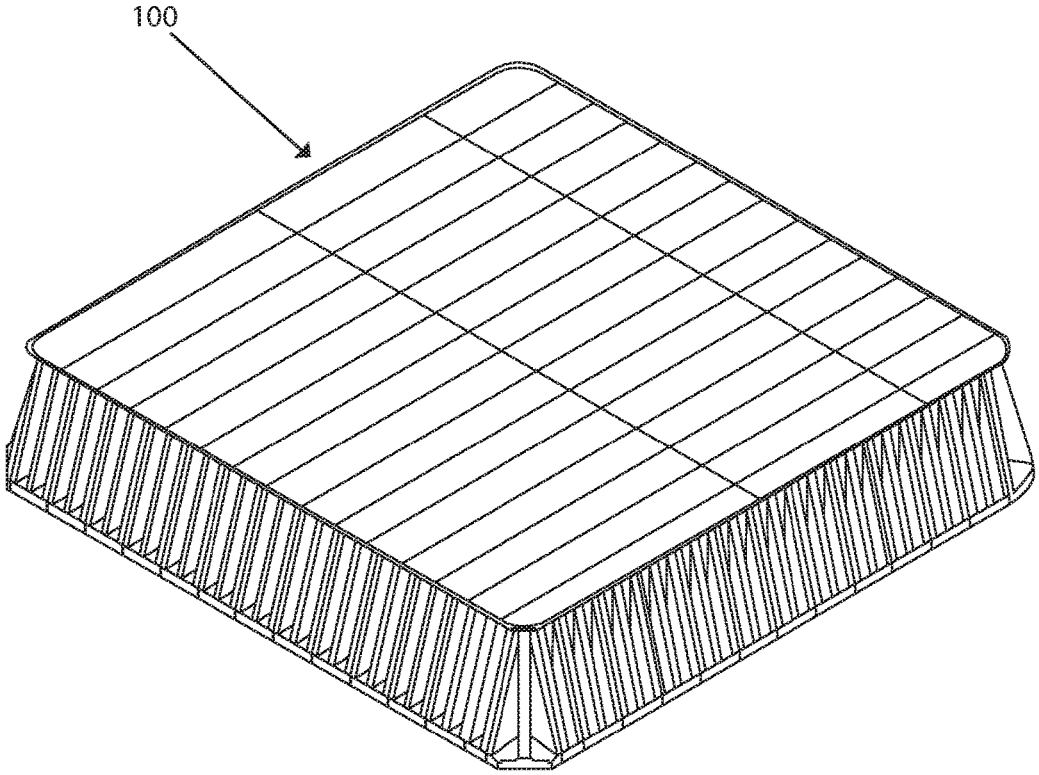
FIG. 6 is a perspective view of an alternate embodiment of the sistema to construct covered liquid storage tank.
Figure 7:
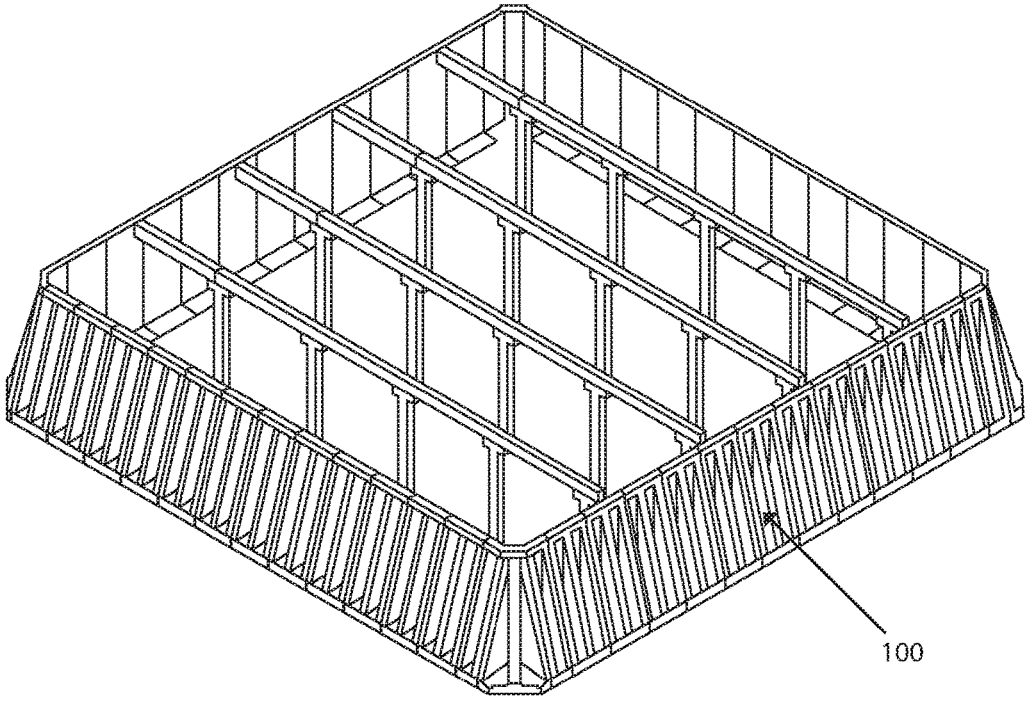
FIG. 7 is a perspective view of the storage tank in which the structure for installing the tank cover is shown.
Figure 8:
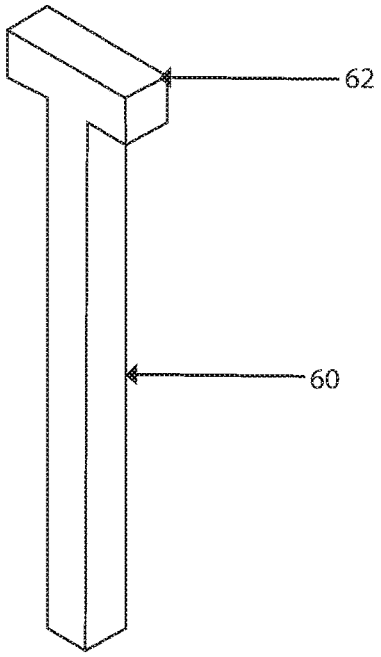
FIG. 8 is a perspective view of a column element of the type used in the structure to support the tank cover.

The system of the present invention provides great versatility, as it allows the construction of uncovered and covered storage tanks (100) (FIG. 1 and FIG. 6, respectively). Furthermore, the modular system can be used for the construction of tanks for wastewater treatment plants, which are able to withstand the hydrodynamic forces that may occur during severe earthquakes.

The system essentially comprises three types of components or modules for the construction of the tank walls and three types of elements for the construction of the tank cover. In addition, all the modular elements are designed and sized for easy transportation and fit the dimensions of the existing vehicles and roads.

The modular elements forming the walls are as follows: wall element (10), fitting element (20) and corner element (30). Due to the geometry of these components, they can be horizontally transported to the construction site and placed vertically on level ground, maintaining a great stability without requiring temporary bracings that hinder the construction process. The elements (10, 20, 30) also have connecting interfaces with the tank foundation or slab set up on the site. This connection provides the modular element with additional rigidity and stability required during a seismic event, whereby the safety of the built construction is ensured.

Figure 9:
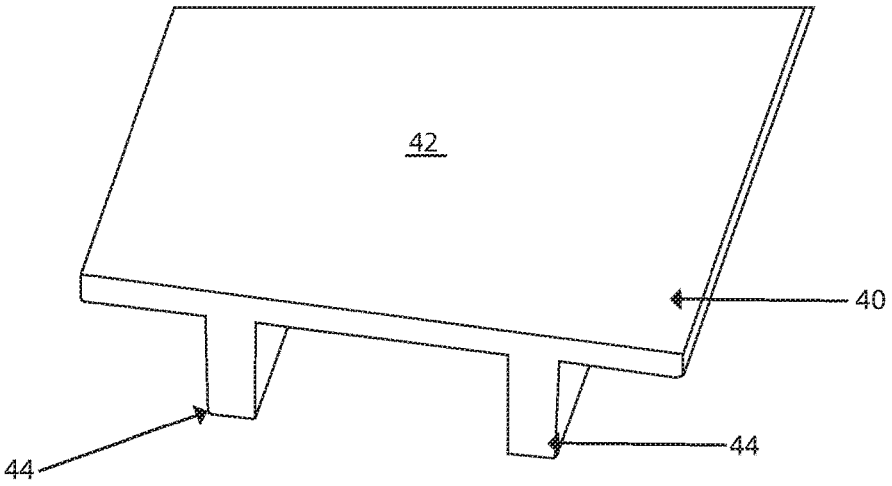
FIG. 9 is a top view of a slab module of the type used in the system for the embodiment of the covered storage tank.
Figure 10A:
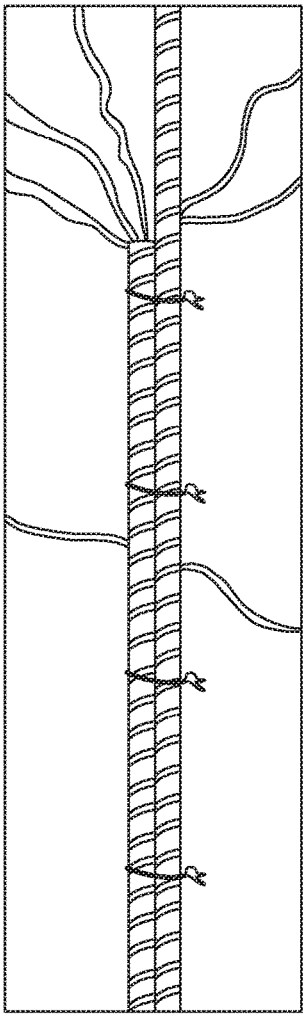
FIGS. 10*a* and 10*b* are exemplary views of connecting elements used for coupling the shoe with the foundation.
Figure 10B:
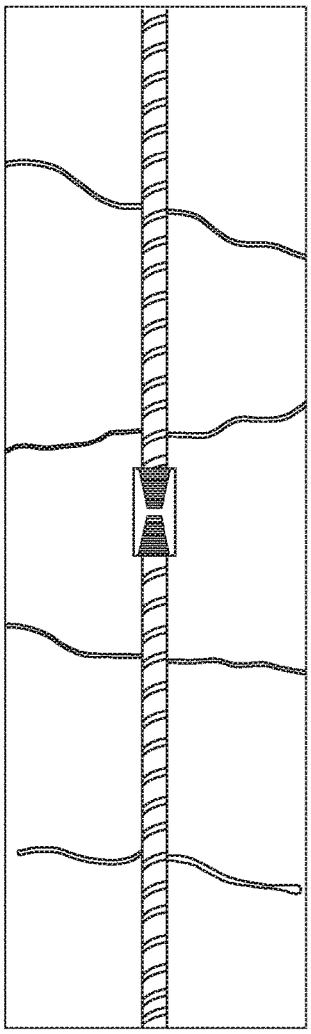
Figure 11:
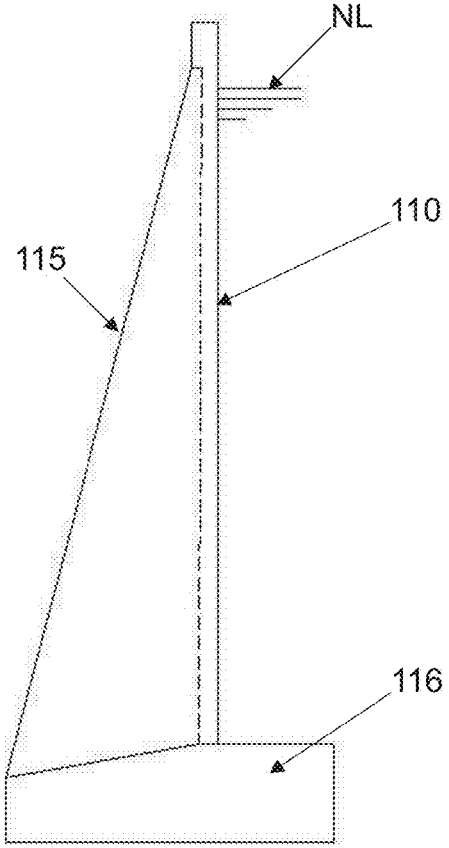
FIGS. 11 and 12 correspond to side and front views, respectively, of a concrete wall element of the type used in the construction system.
Figure 12:
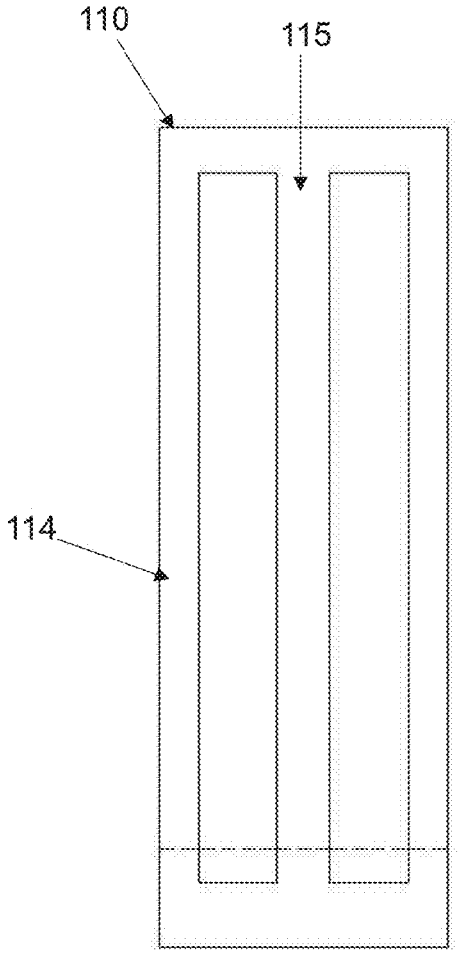

The wall element (10) shown in FIGS. 2*a*-2*d* comprises four basic elements: head or crown (11), cofferdam (12), side buttresses (14) and center buttress (15), and shoe (17). The head (11) serves to accommodate connecting elements for connecting said element (10) with other additional elements to the tank, for example, catwalks or perimeter circulations. Also, said head (11) allows the support of slab modular elements (FIG. 9) in the case of covered tanks. In turn, the cofferdam (12) is the element that directly supports the hydrostatic and hydrodynamic forces of the liquid contained in the tank and is sized to optimize the weight and rigidity of the element (10). This cofferdam (12) is supported by buttresses (14, 15), which transmit loads exerted on said cofferdam (12) to the shoe (17) and their dimensions correspond to the structural and construction requirements that facilitate the manufacture of the element. The shoe (17) engages the bottom slab by conventional means, such as mechanical connectors or corrugated rod overlappings shown in FIGS. 10*a* and 10*b* by way of example, and its dimensions are calculated according to the stability requirements of said element under hydrodynamic effects.

FIGS. 4*a*-4*d* show the fitting element (20), which is similar to the wall element (10) as to the type of elements that form the same, with the difference that said element (20) comprises only two side buttresses (24). The function of the fitting element (20) is to provide adjustment as to the dimension in the tank because the modular elements (10) are of a predetermined width and in some cases it will probably be necessary to construct tanks with dimensions which are not multiples of the predetermined width. Therefore, the use of smaller elements will be required to fit to the dimensions of the tank and facilitate the placement of the corner element (30) and its junction with the foundation or bottom slab of the tank. Similarly, the fitting element (20) comprises a cofferdam (22) on which hydrostatic and hydrodynamic forces are exerted, which are transmitted by the buttresses (24) to the shoe (27) of the fitting element. The head (21) of the fitting element (20) also acts as described hereinbefore for head (11) of the wall element (10).

On the other hand, the corner element (30) shown in FIGS. 3*a*-3*d* is used to connect two perpendicular walls of the tank. Element (30) has design characteristics similar to those of the wall element (10), with the difference that the lateral buttresses (34) of element (30) form an angle of 45° with respect to the central buttress (35).

In an alternate embodiment of the invention, the modular system may also include slab elements to cover the liquid storage tank, when required by the intended use to the same.

The modular elements used for the cover of the storage tank are: slab modular elements (40) (FIG. 9), prefabricated girder (50) and prefabricated column (60). Due to their geometry, several of these elements can be transported stacked on one vehicle. These elements contain elements to engage each other, which could be connecting plates and anchors embedded into the prefabricated element or the bottom slab which may serve for fastening by welding anchors, the amount, type and size of these coupling elements depending on the design and durability requirements. Also, elements for connection to the foundation (columns 60) and walls (prefabricated girders 50) will be provided to transmit and properly distribute static and dynamic loads of the whole structure.

The slab modular element (40) consists of two basic elements: the slab (42) and the ribs (44). The slab (42) is formed by a concrete pad of varying thickness which is dimensioned according to the intended use of the tank cover; for example, said cover can be converted into a green area in the case of buried or half-buried tanks. The ribs (44) are small beams integrated into the top of the slab (42) and are the elements that give the necessary rigidity to the module (40) to cover large gaps.

The prefabricated girder (50) is a straight member having ends configured to mate with the columns (60). At the top, they may include reinforcing bars (not shown), which will be embedded into a subsequent casting to give structural continuity to the slab modules (40) and the girders if required to withstand any seismic event.

The prefabricated column (60) has a head (62) at its top end for engagement with the girder (50), and fastening and leveling means at its base, which may comprise a base plate and anchors embedded in a shoe. The column would have a metal head or plate at the bottom to be attached to the base plate by nuts and leveling nuts to attach to the foundation. It is understood that any other different fastening system can be used for purposes of fastening and foundation provided that it meets the required safety walls.

In another embodiment of the invention, which will be described based on FIGS. 11 to 19, the construction system consists in using prestressed concrete by using a prestressing steel wire or strand of varying diameter, according to structural calculation, embedded in the elements or modules mainly, though maybe not necessarily, which form the wall of the structure to be built.

Once the concrete acquires a predetermined strength, a tensile force is applied to said wire getting great benefits such as reducing the amount of reinforcing steel area, lower cost in manufacturing pre-stressed concrete elements, thinner elements (less robust), greater resistance to tensile stresses required, among others.

Figure 16:
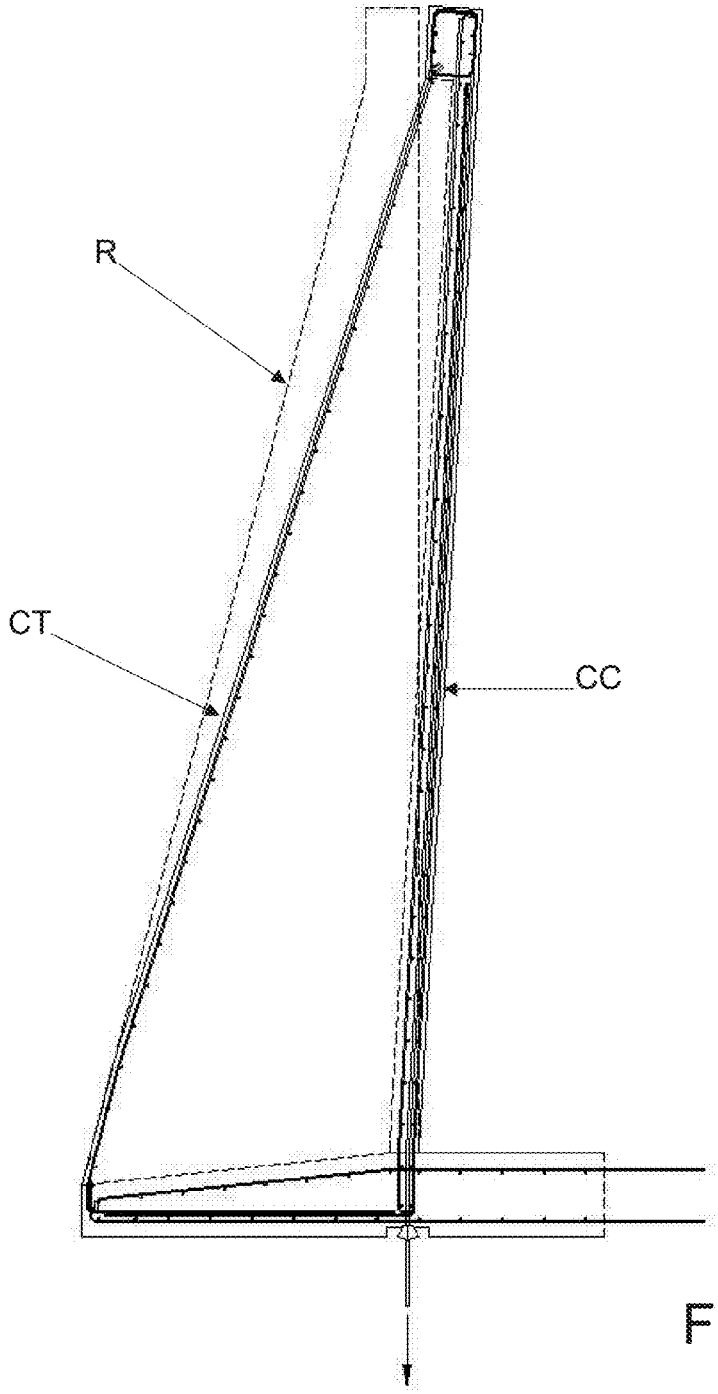
FIG. 16 is a side view of the reinforced concrete wall element under prestress in the wire.
Figures 17, 18, 19:
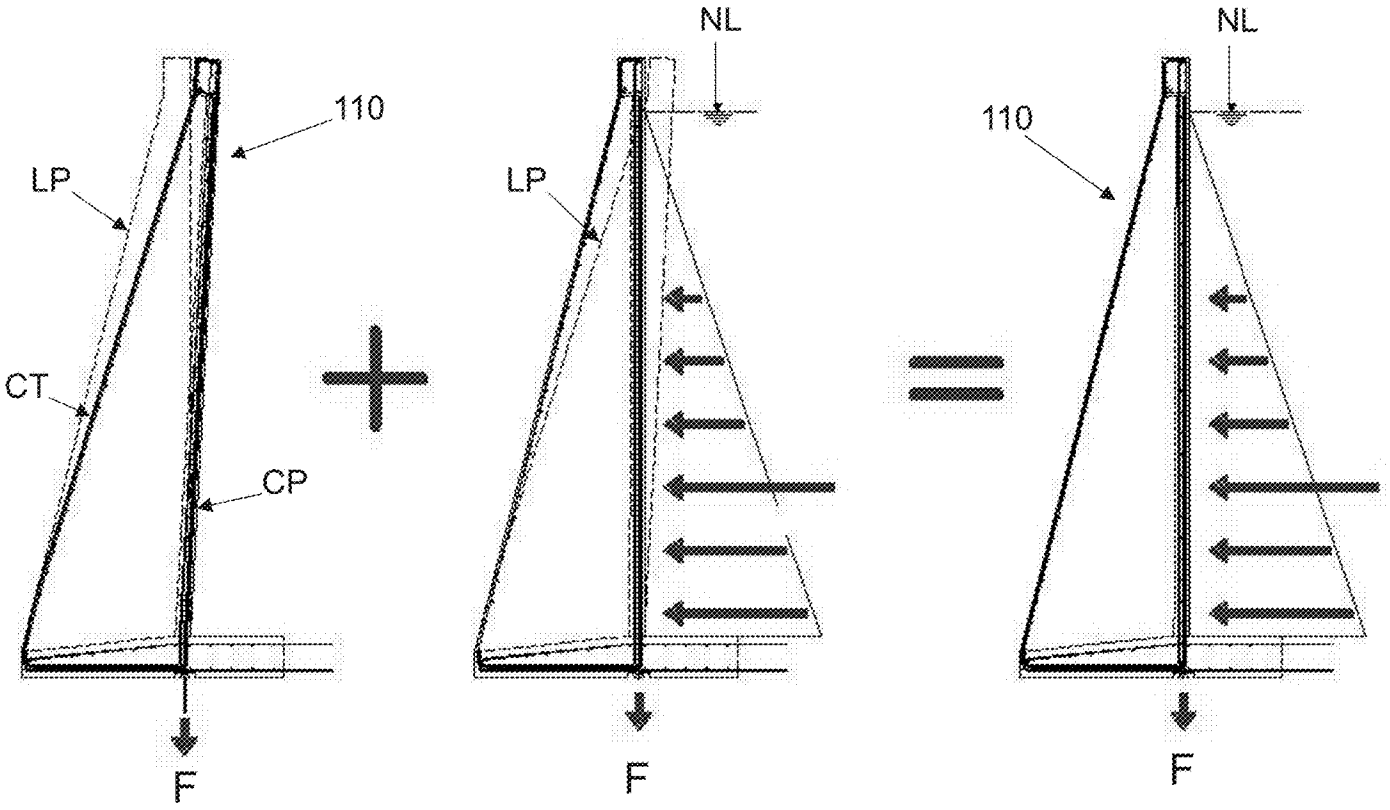
FIGS. 17, 18 and 19 show the overlapping effects of the actuating forces in the reinforced concrete element.
Figure 20A:
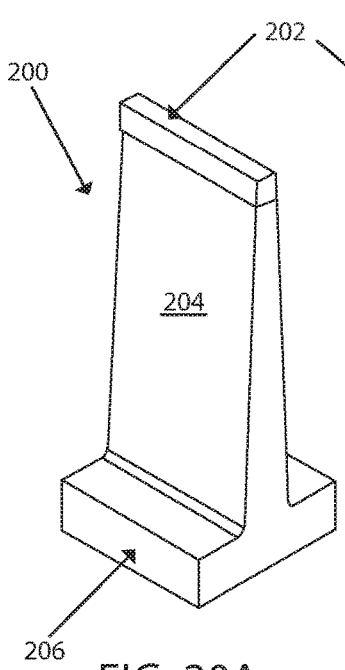
FIGS. 20A, 20B and 20C are different views of the smooth cofferdam used to form divisions or cells inside the storage tank.
Figure 20B:
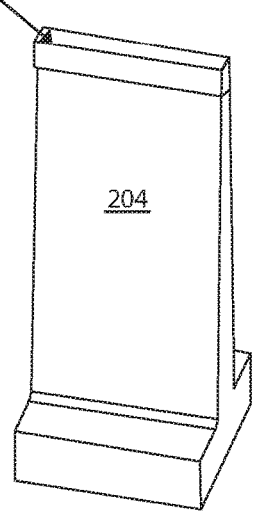
Figure 20C:
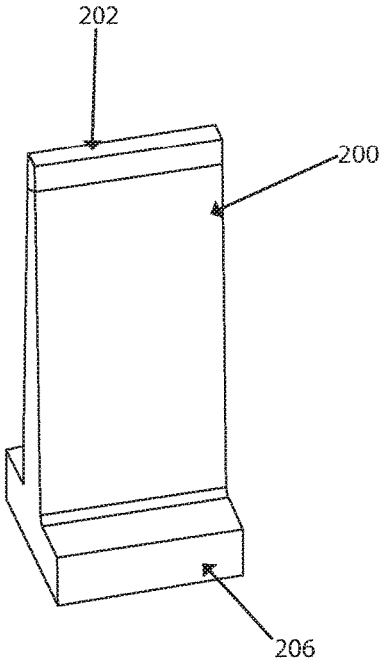
Figure 21A:
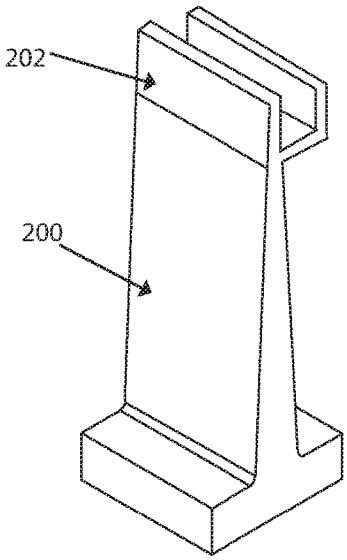
FIGS. 21A, 21B and 21C are alternative modes of the smooth cofferdam to propose a channel-type crown.
Figure 21B:
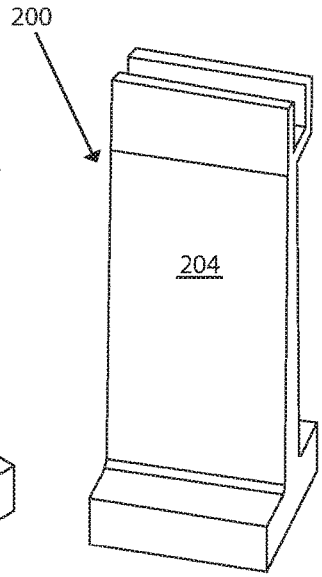
Figure 21C:
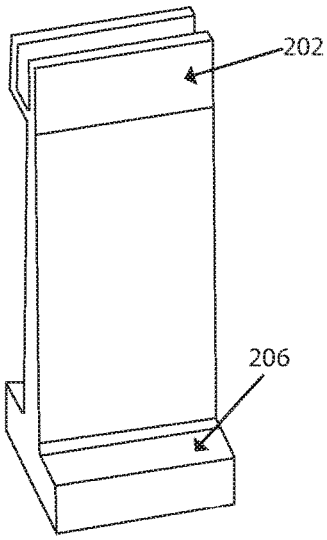
Figure 22:
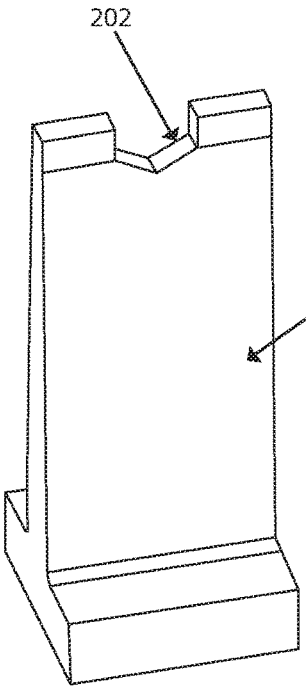
FIGS. 22 and 23 are other alternative modes of the smooth cofferdam, which propose its crown configurated as spillway and passageway, respectively.
Figure 23:
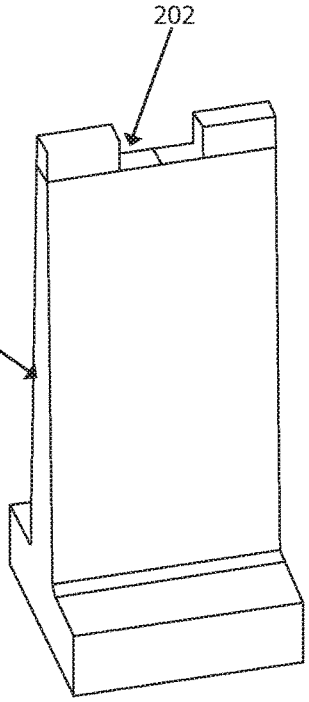
Figure 24A:
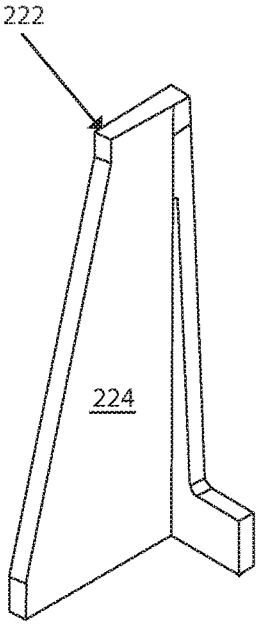
FIGS. 24A, 24B and 24C show different views of the perimeter wall joining element used to form divisions or cells inside the tank.
Figure 24B:
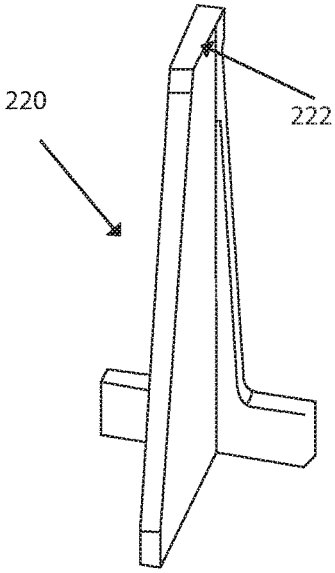
Figure 24C:
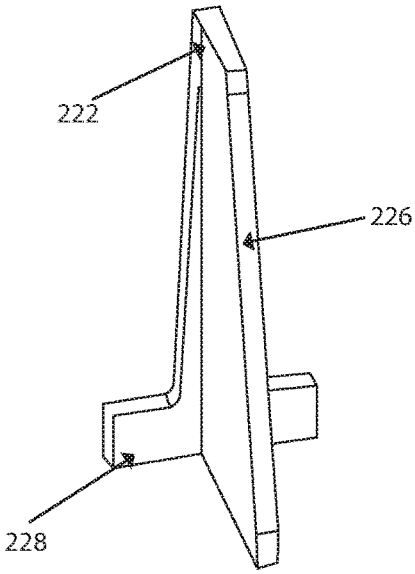
Figure 25A:
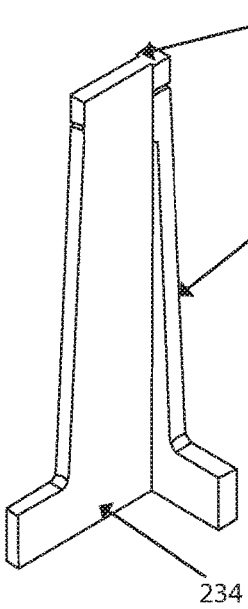
FIGS. 25A, 25B and 25C show different views of the inner wall joining element used to form divisions or cells inside the tank.
Figure 25B:
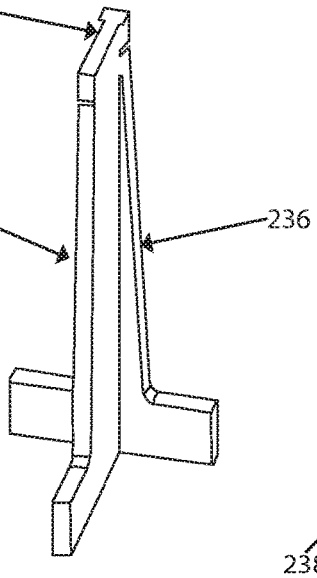
Figure 25C:
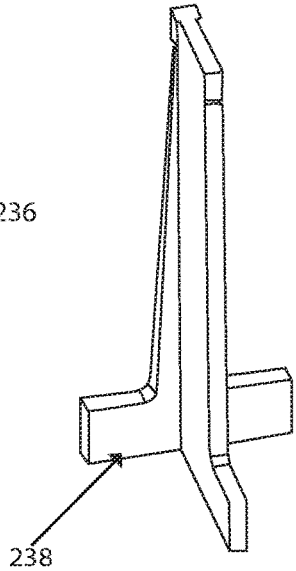
Figure 26A:
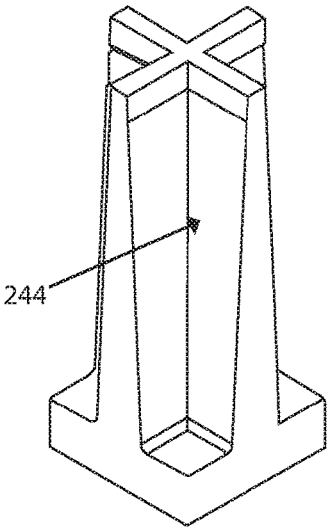
FIGS. 26A, 26B and 26C show different views of the cross-shaped member also used to form divisions inside the tank.
Figure 26B:
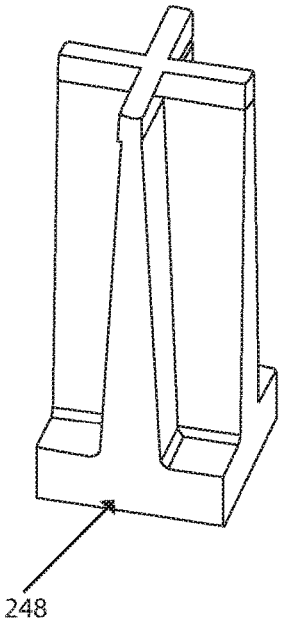
Figure 26C:
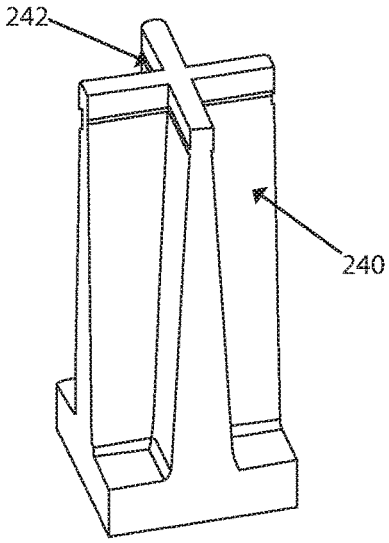
Figure 27:
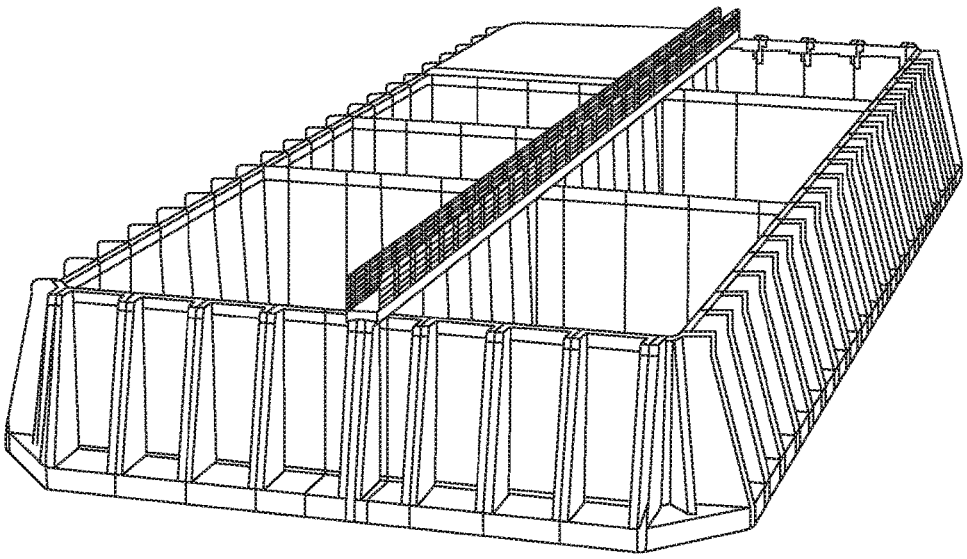
FIGS. 27 and 28 are perspective views of a tank structures constructed by the modular system described herein.
Figure 28:
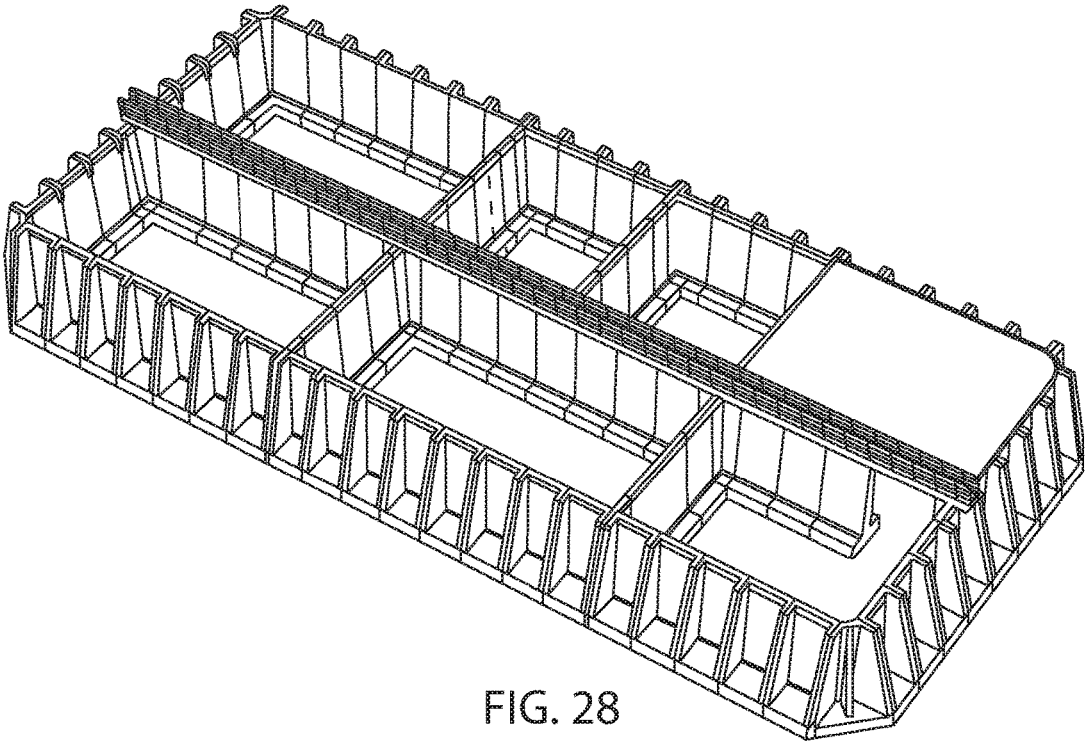
Figure 29:
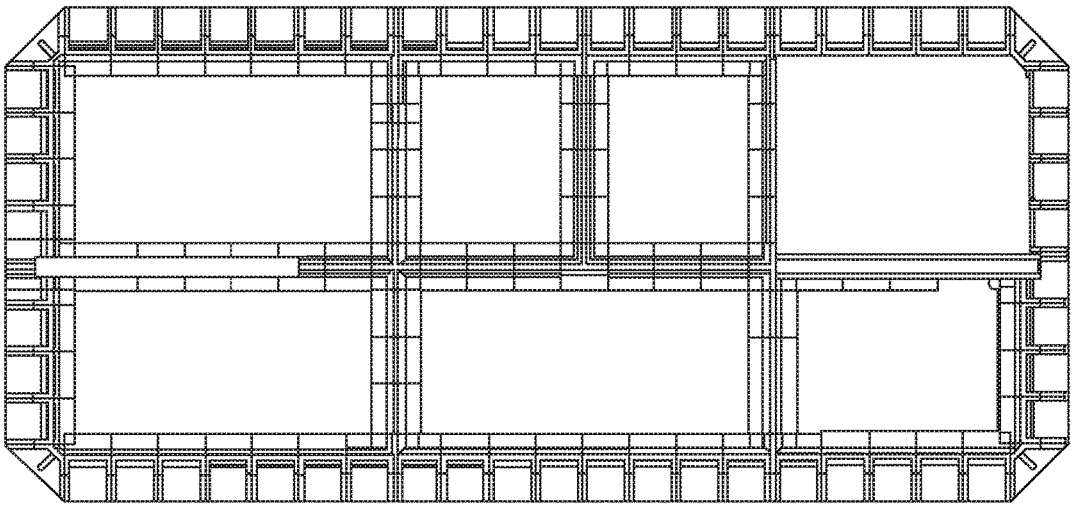
FIG. 29 is a top view of the liquid storage tank partially covered to show an exemplary arrangement of the structure built by the modular system.
Figure 30:
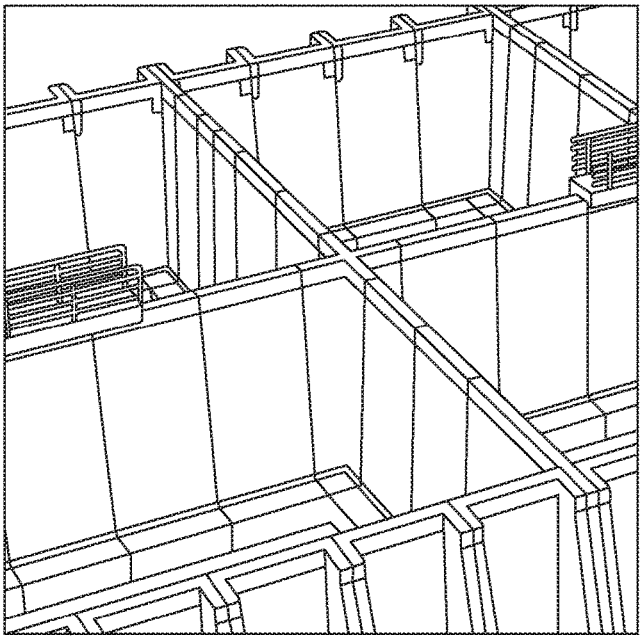
FIG. 30 is an enlarged partial view of the storage tank structure with interior divisions formed by the modular elements of the system.

Using a prestressed wire or strand (120) in prefabricated elements, as mentioned above, brings a number of structural benefits. To prestress the wire or strand it is necessary that the concrete has obtained a compression strength resulting from the concrete setting, as specified structural codes. Once reached said strength, a tensile force is applied to the wire or strand (120) which travels through the entire length causing a compression strength on the wall surface in contact with the stored liquid. This compression stress counters the tensile stresses produced by the different forces to be subject to the wall element. FIG. 16 represents the effect produced in the prestressing wire or strand and FIGS. 17 to 19 illustrate the overlapping effects of the forces in the prefabricated reinforced concrete element.

The prefabricated reinforced concrete wall element (110) comprises five primary elements: the head (111), the cofferdam (113), a prestressing wire or strand (120), side and center buttresses (114, 115) and the shoe (116). The head (111) is adapted to receive connecting elements with various additional elements of the tank, as catwalks or perimeter passages (not shown) and also allows the support of the slab modules for covered tanks. The cofferdam (113) is the element that directly supports the hydrostatic and hydrodynamic forces and is sized to optimize the weight and rigidity of the element (110). The prestressing wire or strand (120) is secured inside the reinforced structure of the cofferdam (112), said wire (120) having means (117) to allow it to adhere to the surrounding set concrete, and also having a pair of anchoring means (124, 125) on its ends to allow the application of a tensile force to the strand and at the same time prevent the cable from slipping inside the element (110).

The cofferdam (113) is supported by the buttresses (114, 115), which transmit the loads from the cofferdam to the shoe (116) and their dimensions are according to the structural and construction requirements that facilitate the fabrication of said element. The shoe (116) connects with the foundation slab by mechanical connectors or corrugated rod overlappings and its dimensions are according to the stability requirements of the said element under hydrodynamic effects.

The cofferdam (113) and buttresses (114, 115) of the wall element can also include horizontal reinforcements (118) and vertical reinforcements (119) in its internal structure (FIG. 13) to have a higher resistance to the hydrostatic and hydrodynamic forces that the walls will be subjected by the liquid stored in the storage structure.

Figure 13:
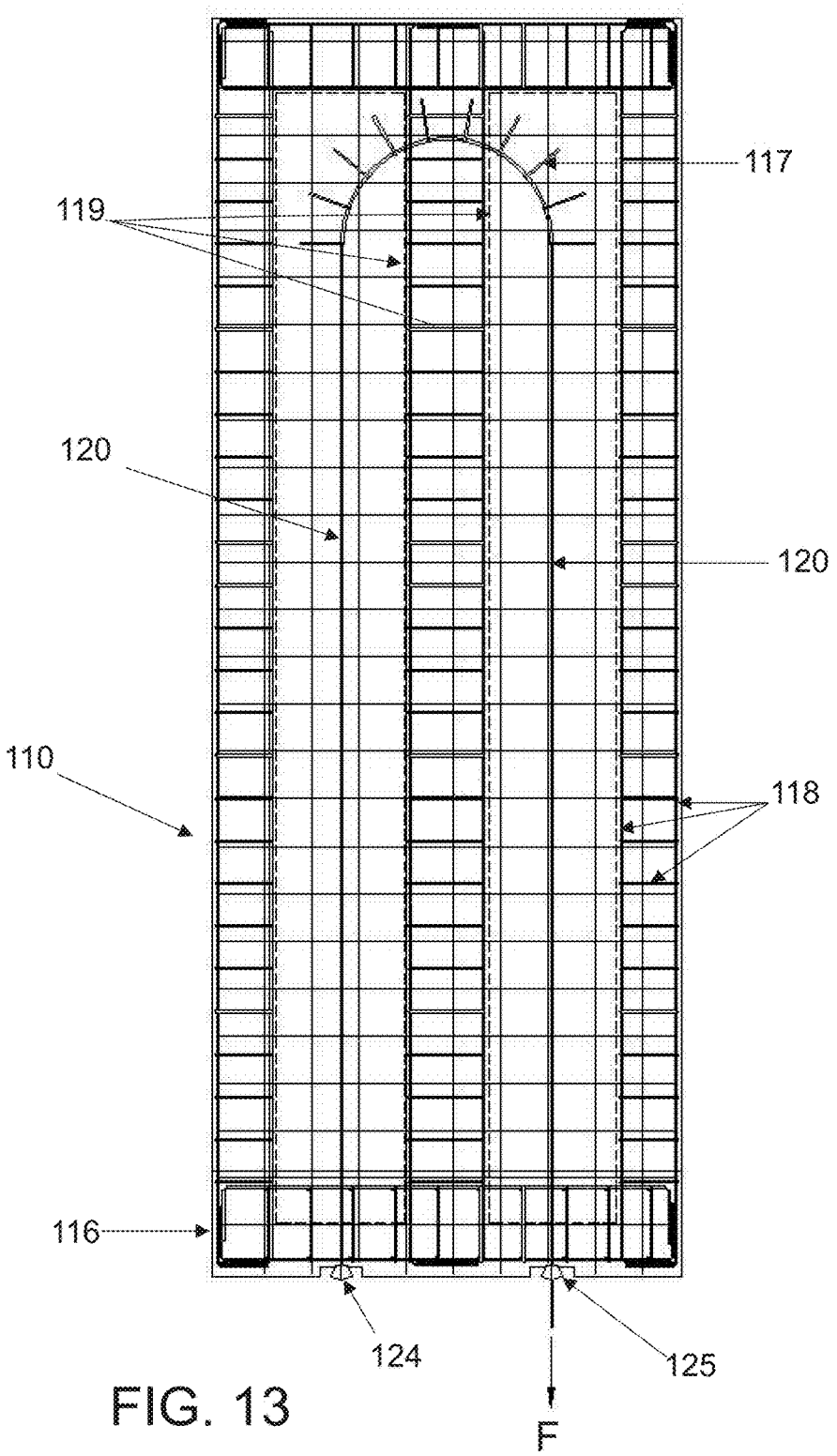
FIG. 13 is a front elevation of a wall element for the tank with the innovations incorporated in its structure.

FIG. 13 represents the wall element in an elevation and vertical cross-section view to show the steel reinforced structure and its disposition therein. As noted, the element (110) includes reinforcements in its side buttresses and in the central buttress. Also, the arrangement of the steel wire or strand is shown, which extends from a fastener (124) disposed in the shoe (116), covering the wall from the bottom of the shoe, and returning to this latter where said wire is fastened by means of an anchoring device (125).

Figure 14:
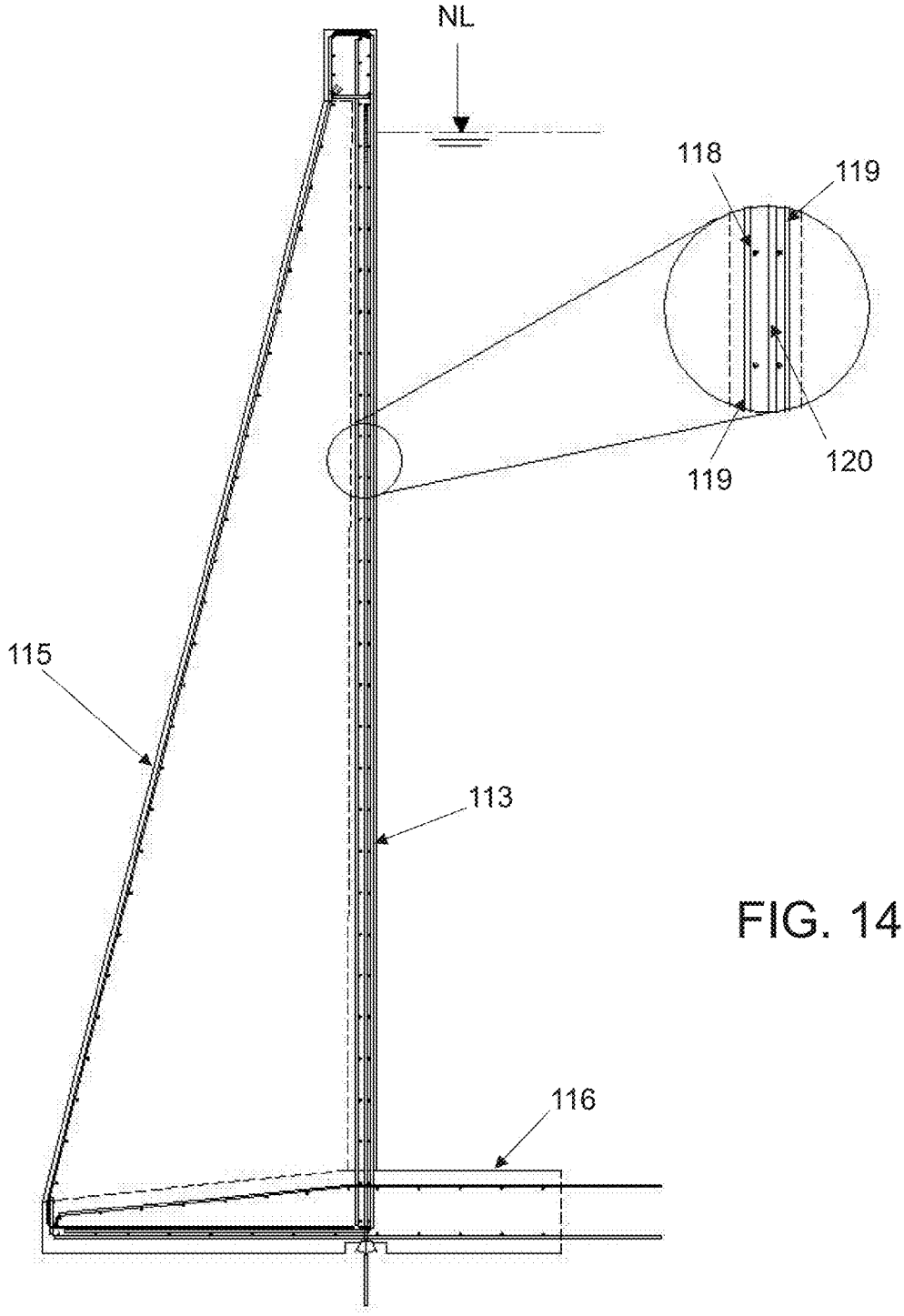
FIG. 14 is a cross sectional side view of the enhanced wall element to show its internal structure.

FIG. 14 corresponds to a vertical cross-section, side view of the element (110), which allows to observe the lateral and vertical reinforcements (118, 119) of said element, and the prestressing wire or strand (120) substantially extending on the plane of the cofferdam (113) of said element.

Figure 15:
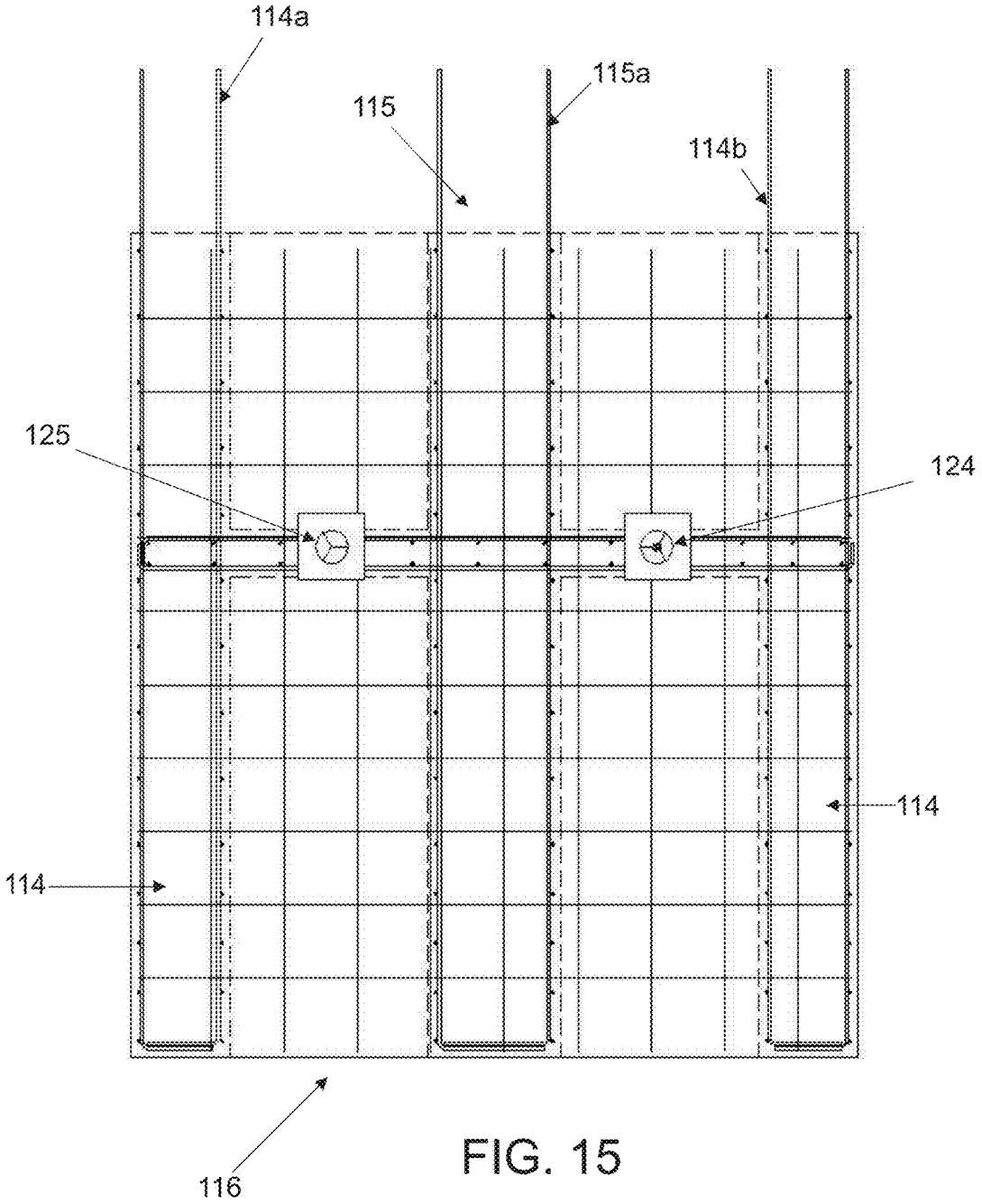
FIG. 15 is a bottom view of the reinforced concrete shoe for the tank walls.

FIG. 15 is a bottom view of the shoe (116) of the wall element (110) to allow for visualization of the wire reinforced of said shoe, which includes reinforcements (114*a*, 114*b*) in the side buttresses (114) and a reinforcement (115*a*) in the central buttress. The fastener (124), from which the wire or strand extends from the shoe traveling innerly the wall element and returning to the shoe to anchor in it by means (125), is also observed.

FIG. 16 is a representation of the wall element (110) with a tensile force applied to the wire or strand (120) causing an under compression effect (CC) on the cofferdam (113) and an under tension effect (CT) on the abutments (114, 115). As represented in this FIG. 16, as a result of the tension applied to the wire (120), the wall element tends to project toward the front from a reference line (R)—no force applied—, in a displacement whose magnitude will depend on the tensile force applied to said wire (120). For clarity of that effect, the produced displacement has been dramatically exaggerated in this figure.

FIGS. 17 to 19 of the invention is a sequential representation showing the effects on the wall element (110), in a first condition of prestressing (FIG. 17) with tension force applied to the wire (120), where the dotted line (LP) represents the projection on the wall without prestressing strand. In this condition, the face of the cofferdam is under compression (CP) and the face of the buttresses under tension (CT). Next, FIG. 18 illustrates wall element subjected to the hydrostatic pressure of the stored liquid (NL), producing a "backwards" pushing effect on the wall, causing the wall returns to the position in a condition without prestressing the wire or strand. In this FIG. 18, the dotted lines (LP) represent the projection of the wall element in a prestressing strand condition. Finally, FIG. 19 shows an image of the wall in a "balanced" condition caused by the forces exerted by the prestressing wire and the hydrostatic pressure exerted by the liquid on the wall (initial displacement resulting from the tension applied to the strand+ displacement resulting from hydrostatic pressure of the stored liquid=0). In FIGS. 18 and 19, arrow (F) represents the tensile force in the wire or strand.

The process of construction of the prefabricated reinforced concrete wall elements comprises: a) assemble the body of the element (110) with the necessary corrugated rods or rebars according to the structural calculation; and b) incorporate a prestressing wire (120) into said reinforced wall element in such a geometric arrangement that when a tensile force is applied to said wire, it is uniformly transmitted to the concrete.

The wire (120) will be provided with an insulating coating all over its length to assure the distribution of tensile force and avoid eventual local efforts in said element because of adhesion to the concrete.

In a further embodiment of the invention, the constructive system comprises other additional modular elements adapted to form subdivisions or cells within the tank as seen in FIGS. 27-30. Such elements comprise smooth cofferdam (200), fitting smooth cofferdam (210), perimeter wall joining element (220), inner wall joining element (230) and cross-shaped member (240). As the modular elements described hereinbefore, these elements include joining means for fastening to each other and to the foundation and walls to properly transmit and distribute the static and dynamic forces in the entire structure of the tank. The same as the elements described previously, these additional elements have the advantage to be transported stacked in the same vehicle.

The smooth cofferdam (200) comprises three primary elements: the head (202), the cofferdam (204), and the shoe (206). The head (202) is adapted to receive connecting elements with various additional elements to the tank, e.g. catwalks or perimeter passages and also supports the slab modules (40) in case of covered tanks. The cofferdam (204) is the element that directly supports the hydrostatic and hydrodynamic forces of the liquid contained in the tank and is sized to optimize the weight and rigidity of the smooth cofferdam (200). Also, the cofferdam (204) transmits the loads to the shoe (206). The shoe is connected to the bottom slab by mechanical connectors or corrugated rod overlappings, and the shoe dimensions are according to the stability requirements of the cofferdam under hydrodynamic effects.

The versatility of the smooth cofferdam (200) allows to anticipate pipe installations, either circular or rectangular shape. In addition, the head (202) can be removed in whole or part from the cofferdam to generate landfills, clearances for piping, etc. Likewise, the head (202) of the cofferdam can be replaced by any form that is required, for example, to generate an independent channel parallel to the cofferdam (200), or to accommodate special accessories required for the intended use of the storage tank.

The fitting smooth cofferdam (210) is essentially a smooth cofferdam (200) but of different length, whose function is to adjust the longitudinal dimension of the cell or subdivision. The versatility of the fitting smooth cofferdam (210) is identical to that of the smooth cofferdam (200).

The perimeter wall joining element (220) is an element adapted to act as an interface between the perimeter wall and the dividing wall. Its configuration results from the intersection of the geometries of the element (10, 110) and the smooth cofferdam (200), said joining element having a buttress (226) at one end and a smooth cofferdam (224) parallel to the buttress at the other end. The perimeter wall joining element (220) comprises the following elements: a head or crown (222), the cofferdam (224), the buttress (226) and a shoe (228). The head (222) has the same functions as in the smooth cofferdam (200). The cofferdam (224) receives the hydrostatic and hydrodynamic forces and transmits them to the shoe (228) and the perimeter wall. The buttress (226) is the element of the joining element that joins the perimeter wall and in turn transmits forces to same. The shoe (228) is the element which connects with the bottom slab by mechanical connectors or corrugated rod overlappings and its dimensions are according to the requirements of stability of the joining element (220) under hydrodynamic effects.

The function of the inner wall joining element (230) is similar to that of the perimeter wall joining element (220), except that element (230) is used to connect two interior walls. Its configuration results from the intersection of two smooth cofferdams (200) intersecting perpendicularly, which generates a T-shaped element connecting with a perpendicular smooth cofferdam. The inner wall joining element (230) comprises a head or crown (232), a supporting element (234), a cofferdam (236) and a shoe (238). The head functions as in the flat screen (200). The supporting element (234) is adapted to join the two perpendicular inner walls and transmits forces between them. The cofferdam (236) receives the hydrostatic and hydrodynamic forces and transmits them to the supporting element (234) and the shoe (238). The shoe acts as a connecting means with the bottom slab by mechanical connectors or corrugated rod overlappings and its dimensions are according to the stability requirements of the joining element under hydrodynamic effects.

The cross-shaped member (240) is used when multiple cells or divisions of the tank are required and two walls of smooth cofferdams (200) intersect to generate four divisions inside the tank. The cross-shaped member (240) acts as a connecting element between the two walls that intersect one another. Its configuration results from the intersection of two smooth cofferdams (200) intersecting perpendicularly, resulting in a cross-shaped member to couple with two perpendicular smooth cofferdams. The components of the member (240) are the head (242), the cross-shaped cofferdam (244) and the shoe (248). The head has the same functions as in the smooth cofferdam. The cross-shaped cofferdam is adapted to join the two perpendicular inner walls and transmits loads between them. Also, it receives the hydrostatic and hydrodynamic forces and transmits them between the walls and the shoe. The shoe (248) connects with the bottom slab by mechanical connectors or corrugated rod overlappings and its dimensions are according to the stability requirements of the element under hydrodynamic effects.

Based on the modular elements described above, at ground level, buried, partially buried, covered or uncovered tanks can be constructed to contain drinking water, waste water or other industrial fluids.

On the other hand, for proper sealing of the tank walls which are subject to positive and negative hydrostatic pressures, conventional products to seal cold joints between prefabricated concrete elements are used. For example, products such as a polyurethane elastic sealant or a preformed plastic sealant can be used. It is understood that any other suitable product can be used for the same purposes.

Although the invention has been described according to the preferred embodiments it will be understood that various modifications or changes thereto may be implemented without implying that depart from the spirit and inventive concept. It will therefore be apparent that the scope of the invention to any other variations or method of use or application to be deductible and obviously derivable in light of what has been described hereinbefore will be extended, so that the scope of protection should be determined solely by the content of the following claims.

What is claimed is:

1. A modular system for the construction of liquid storage tanks comprising modular elements to build the walls of the storage tank, said system comprising:

a plurality of wall elements (10) which are interconnected side by side to define jointly a predetermined length of wall of the tank;

fitting elements (20) for connection with the outermost wall element of the wall formed by the wall elements;

corner elements (30), adapted to be placed at each corner of the tank structure, said corner elements are connected laterally with respective fitting elements;

wherein the elements (10, 20, 30) further include coupling elements to be connected to the foundation or bottom slab of the tank; and covering elements to cover the storage tank, said covering elements comprising:

a plurality of slab modular elements (40) having ribs or beams strategically placed to give each slab element the stiffness required to cover large gaps;

columns strategically placed in the fluid containment area to assist in forming a slab support structure, each column having a head or crown at the top for engagement with the slab modular elements and means for fixing and connecting with the foundation; and girders that are placed on the head of the columns to form altogether a support structure on which the slab modular elements are placed to cover the tank.

2. The modular system of claim 1, wherein the wall element (10) comprises:

a head or crown (11) including coupling elements for coupling with additional elements to the tank; said head or crown further acts as a support for cover elements when a covered tank is constructed;

at least one cofferdam (12) extending longitudinally in the wall element, said cofferdam directly supports the hydrostatic and hydrodynamic forces of the fluid stored in the tank and is sized to optimize the weight and rigidity of the wall element (10);

central and lateral buttresses (14, 15) that support the cofferdam and transmit the forces exerted on it to the foundation; and a shoe (17) acting as an element for coupling the wall with the tank bottom slab by mechanical connectors or rebars over-lapping.

3. The modular system of claim 1, wherein the fitting element (20) comprises:

a head or crown (21) at the top, which includes coupling elements for coupling with additional elements to the tank; said head further acts as a support for cover elements when a covered tank is constructed;

at least one cofferdam (22) extending longitudinally in the fitting element, said cofferdam directly supports the hydrostatic and hydrodynamic forces of the fluid stored in the tank and is sized to optimize the weight and rigidity of the fitting element (20);

lateral buttresses (24) that support the cofferdam and transmit the forces exerted on it to the foundation; and a shoe (27) acting as an element for coupling the wall with the tank bottom slab by mechanical connectors or rebars over-lapping.

4. The modular system of claim 1, wherein the corner element (30) comprises:

a head or crown (31) at the top, which includes coupling elements for coupling with additional elements to the tank; said head further acts as a support for cover elements when a covered tank is constructed;

a cofferdam (32) extending longitudinally in the corner element, said cofferdam directly supports the hydrostatic and hydrodynamic forces of the fluid stored in the tank and is sized to optimize the weight and rigidity of the corner element (30);

central and lateral buttresses (34, 35) that support the cofferdam and transmit the forces exerted on it to the foundation; and a shoe (37) acting as an element for coupling the wall with the tank bottom slab by connecting means;

wherein the side buttresses form a 45° angle relative to the central abutment (35).

5. The modular system of claim 1, wherein each slab modular elements includes means for coupling with other adjacent slab modular elements to form jointly the tank cover.

6. The system of claim 1, further comprising elements to form subdivisions or cells within the tank, said elements comprising:

smooth cofferdams (200) comprising: a crown or head (202) having connecting means for connecting with other elements of the tank and which also acts as support of slab elements in case of covered tanks; a cofferdam (204) that receives the hydrostatic and hydrodynamic forces and is sized to optimize the weight and rigidity of the smooth cofferdam (200), and a shoe which is to be connected to the bottom slab of the tank to transmit the said forces, which in turn receives said forces from the cofferdam (204);

fitting smooth cofferdams (210) having similar characteristics to those of the smooth cofferdams (200) but different lengths, which are used to adjust the longitudinal dimension of the cells or subdivisions;

perimeter wall joining elements (220) that act as an interface between the perimeter wall and the dividing wall, each element (220) comprises: a crown or head (222) having connecting means to connect with other tank elements, said crown also serves as support of slab elements in case of covered tanks; a cofferdam (224) that receives the hydrostatic and hydrodynamic forces and transmits them to the shoe (228) and the perimeter wall; a buttress (226) joining the perimeter wall and in turn transmits forces to same; and a shoe (228) serving as connecting element of the structure with the bottom slab of the tank;

inner wall joining elements (230) acting as elements for connecting two inner walls, each joining element (230) is constituted by a crown (232) which receives an attachment means to connect to other elements of the tank and also serves as support of slabs in case of covered tanks; a supporting element (234) acting as a junction between two perpendicular interior walls and transmitting forces between them; a cofferdam (236) that receives the hydrostatic and hydrodynamic forces and transmits them to the supporting element (234) and the shoe (238); and a shoe (238) which serves as connecting element of the structure with the bottom slab of the tank; and cross-shaped members (240) acting as connecting elements between two walls that intersect one another to generate divisions or cells inside the tank; each cross-shaped member comprises: a crown (242) receiving connecting means to connect with other elements of the tank and also to serve as supports of the slab in case of covered tanks; a cross-shaped cofferdam (244) adapted to attach to two perpendicular interior walls and transmit forces between them, said cross-shaped cofferdam receives hydrostatic and hydrodynamic forces and transmits them between the walls and the shoe; and a shoe (248) that acts as a connecting element between the structure and the bottom slab of the tank.

7. A modular system for the construction of storage tanks for liquids, comprising modular elements to build the walls of the storage tank, said modular elements comprising:

a) a plurality of wall elements (10) which are interconnected side by side to define jointly a predetermined length of wall of the tank; each wall element (10) comprising:

a.1) a head or crown (11) at the top, which includes coupling elements for coupling with additional elements to the tank; said head further acting as a support for cover elements when a covered tank is constructed;

a.2) at least one cofferdam (12) extending longitudinally in the wall element, said cofferdam directly supports the hydrostatic and hydrodynamic forces of the fluid stored in the tank and is sized to optimize the weight and rigidity of the wall element (10);

a.3) central and lateral buttresses (14, 15) that support the cofferdam and transmit the forces exerted on it to the foundation; and a.4) a shoe (17) acting as an element for coupling the wall with the tank bottom slab by mechanical connectors or rebars over-lapping.

b) fitting elements (20) for connection with the outermost wall element of the wall formed by the wall elements; each fitting element (20) comprising:

b.1) a head or crown (21) at the top, which includes coupling elements for coupling with additional elements to the tank; said head further acting as a support for cover elements when a covered tank is constructed;

b.2) at least one cofferdam (22) extending longitudinally in the fitting element, said cofferdam directly supports the hydrostatic and hydrodynamic forces of the fluid stored in the tank and is sized to optimize the weight and rigidity of the fitting element (20);

b.3) lateral buttresses (24) that support the cofferdam and transmit the forces exerted on it to the foundation; and b.4) a shoe (27) acting as an element for coupling the wall with the tank bottom slab by mechanical connectors or rebars over-lapping; and c) corner elements (30), adapted to be placed at each corner of the tank structure, said corner elements are connected laterally with respective fitting elements; each corner element comprising:

c.1) a head or crown (31) at the top, which includes coupling elements for coupling with additional elements to the tank; said head further acts as a support for cover elements when a covered tank is constructed;

c.2) a cofferdam (32) extending longitudinally in the corner element, said cofferdam directly supports the hydrostatic and hydrodynamic forces of the fluid stored in the tank and is sized to optimize the weight and rigidity of the corner element (30);

c.3) central and lateral buttresses (34, 35) that support the cofferdam and transmit the forces exerted on it to the foundation; said lateral buttresses form a 45° angle relative to the central abutment (35);

c.4) a shoe (37) acting as an element for coupling the wall with the tank bottom slab by mechanical connectors or rebars over-lapping;

wherein the elements (10, 20, 30) further include coupling elements to be connected to the foundation or bottom slab of the tank; and wherein the covering elements for covering the storage tank comprise:

a plurality of slab modular elements (40) having ribs or beams strategically placed to give each slab element the stiffness required to cover large gas;

columns strategically placed in the fluid containment area to assist in forming a slab support structure, each column having a head or crown at the top for engagement with the slab modular elements and means for fixing and connecting with the foundation; and beams that are placed on the head of the columns to form altogether a support structure on which the slab modular elements are placed to cover the tank.

8. The modular system of claim 7, further including covering elements to cover the tank, which are configured to couple with the elements (10, 20, 30) forming the tank wall.

9. A system for constructing liquid storage tanks based on prestressed concrete prefabricated elements, comprising prefabricated reinforced concrete modular elements that fit together to form the walls of the storage tank, said system comprising:

a) a plurality of reinforced concrete wall elements that are interconnected side by side so that together define a predetermined length of tank wall; each wall element comprises a head or crown on the top, which includes elements for coupling with other additional elements to the tank; said head is also adapted to support slab elements when a covered tank is constructed; at least a cofferdam longitudinally extending in the wall element; said cofferdam directly supports the hydrostatic and hydrodynamic forces of the liquid stored in the tank and is sized to optimize the weight and rigidity of the wall element; and central and lateral buttresses adapted to support the cofferdam and transmit the forces exerted on it to the foundation; and a shoe acting as an element for engagement with the bottom slab of the tank by mechanical connectors or corrugated rod over-lapping;

b) fitting elements interconnecting with the outermost wall element of the wall formed by the wall elements; and c) corner elements placed in each corner of the tank structure; said corner elements are connected laterally with respective fitting elements; each of the wall and fitting and corner elements includes coupling means to connect to the foundation or bottom slab of the tank; wherein the wall elements comprise at least one pre-stressing wire or strand embedded in its structure, and once the concrete has reached a compression strength as a result of the concrete setting a tensile force is applied to the wire or strand which travels through the entire causing a compression strength on the wall surface in contact with the stored liquid.

10. The system of claim 9, wherein the compression stress produced on the wall is opposed to the tensile stresses produced by the different forces to be subjected to the wall element.

11. The system of claim 9, wherein said wire or strand includes means to allow it to adhere to the surrounding set concrete enough to transmit the required compression force to the wall element.

12. The system of claim 9, wherein said shoe of the wall element includes fastening means for anchoring said wire or strand to the bottom of the shoe.

13. The system of claim 9, wherein the wire comprises an insulating coating all over its length to assure the distribution of the tensile force and avoid eventual local efforts in said element because of adhesion to the concrete.

* * * * *